United States Patent [19]

Hane et al.

[11] 4,329,925

[45] May 18, 1982

[54] FRACTURING APPARATUS

[75] Inventors: Paul C. Hane; Harold D. Moore, both of Longview, Tex.

[73] Assignee: Frac-Well, Inc., Longview, Tex.

[21] Appl. No.: 160,191

[22] Filed: Jun. 17, 1980

[51] Int. Cl.[3] ..... F42B 1/02; E21B 29/02

[52] U.S. Cl. ..... 102/310; 166/63; 166/299; 175/4.6

[58] Field of Search ..... 166/63, 299; 175/4.6; 102/310, 306, 307, 308, 313, 314, 318, 320, 322

[56] References Cited

U.S. PATENT DOCUMENTS

| | | | |
|---|---|---|---|
| 2,831,429 | 4/1958 | Moore | 102/307 |
| 2,935,020 | 5/1960 | Howard et al. | 102/310 X |
| 3,013,491 | 12/1961 | Poulter | 102/310 |
| 4,018,293 | 4/1977 | Keller | 102/307 X |
| 4,081,031 | 3/1978 | Mohaupt | 166/299 |
| 4,091,870 | 5/1978 | Godfrey et al. | 166/63 X |
| 4,160,412 | 7/1979 | Snyer et al. | 102/310 X |
| 4,248,303 | 2/1981 | Charpentier | 166/299 |

*Primary Examiner*—David H. Brown

*Attorney, Agent, or Firm*—James C. Fails

[57] ABSTRACT

An improvement in an apparatus for fracturing subterranean formation by explosive fracture wherein opposed end charges are detonated to enhance the explosive capability of a central charge, the improvement comprising intermediate driver charges intermediate the central charge in each of the respective end charges; the driver charges being detonated by the end charges to provide a sustained pressure wave for enhancing the rubblizing and fracturing of the subterranean formation and extend the fracture more deeply into the subterranean formation. Also disclosed are improved apparatus enabling carrying out the split second detonating of the respective explosive charges, containing the explosive charges without entangling cable and the like downhole and preventing misfiring.

8 Claims, 14 Drawing Figures

Fig. 5
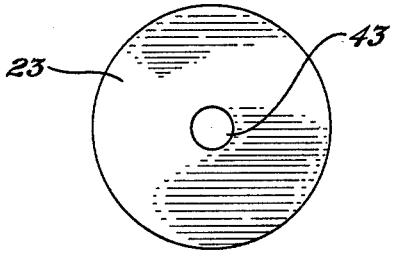
Fig. 6
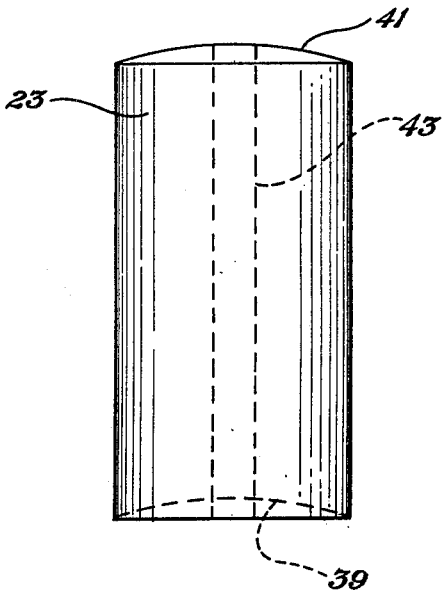
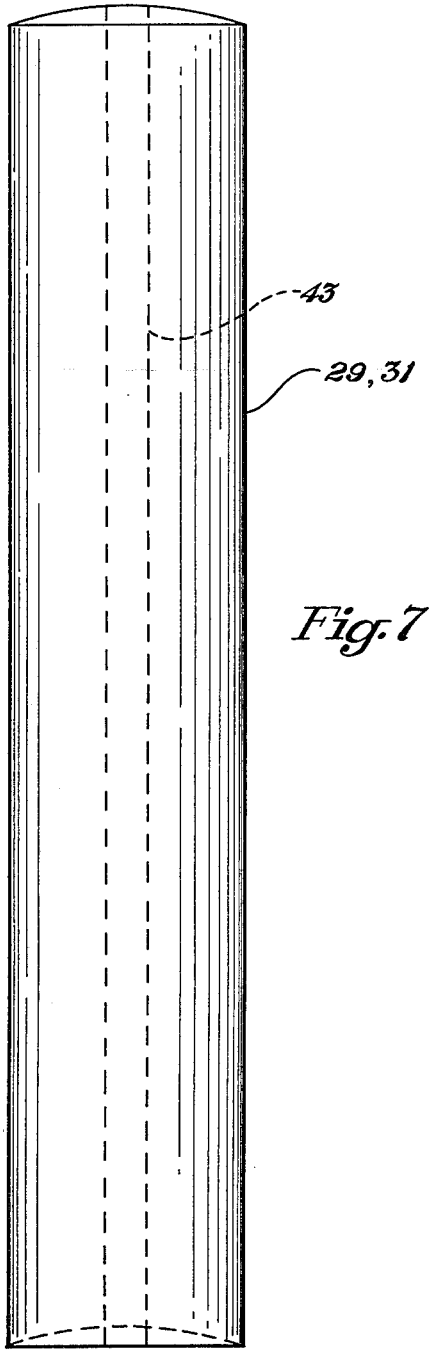
Fig. 7

FRACTURING APPARATUS

FIELD OF THE INVENTION

This invention relates to explosive fracturing devices for fracturing subterranean formations. More specifically, the invention relates to well treating apparatus for fracturing subterranean formation by explosive means that provides an implosive effect to increase peak pressure and fracture propagation and thereby increase the flow rate of a fluid from a subterranean formation. Still more particularly, this invention relates to apparatus for fracturing a subterranean formation for increasing the production of oil or gas from the subterranean formation.

DESCRIPTION OF THE PRIOR ART

Flow of a fluid such as oil, gas or water from a subterranean formation requires that the formation be permeable. This is particularly noteworthy in oil and gas production where the oil or gas from a more remote region of the subterranean formation has to migrate toward and flow into a production well.

The production well bores are frequently fouled during drilling; are innately restrictive in permeability, particularly immediately adjacent the well bore; or are subsequently plugged by sedimentation or build-up of contaminants from the fluid adjacent the well bore. One commonly used technique that is employed to open up the permeability of a production well is to fracture the subterranean formation. The fracturing of the subterranean formation has been done in the past by several techniques, including explosive fracturing, hydraulic fracturing and the like.

The use of hydraulic fracturing techniques requires expensive protracted time by a crew employing expensive high pressure high volume pumping equipment pumping a hydraulic fracturing fluid and propping agents and the like into the well bore. Explosive fracturings have been known in the prior art but have been limited, because they have been high frequency energy that did not penetrate the subterranean formation with fractures as deeply as desired and they caused substantial damage to a well.

Typical of the prior art configurations of shaped charges are U.S. patents; such as U.S. Pat. Nos. 3,013,491; 2,935,020 and 2,831,429 showing different types of penetrations through casings and into a formation by shaped charges or the like. These are limited in usefulness for fracturing a subterranean formation however. An improvement was set forth in U.S. Pat. No. 4,160,412 employing a central charge with end charges to reinforce the central charge and having a reactive metal to vaporize upon detonation of end charges and effect a more sustained high pressure wave, at least in theory.

In point of fact, the prior art apparatus did not satisfactorily solve the problems and provide the desired objectives of having a sustained high pressure that would fracture extensively around a well bore to form a large effective well bore diameter; and, yet, propagate a fracture deeply into the subterranean formation without having damage so extensive as to ruin the production well. Expressed otherwise, explosive fracturing could not be assured of success in propagating the fracture without damaging the zone of production before this invention.

SUMMARY OF THE INVENTION

Accordingly, it is an object of this invention to provide an improved fracturing apparatus and method that can provide an enlarged effective well bore diameter and a fracture propagated deeply into formation without intolerable damage to well downhole equipment.

It is a specific object of this invention to provide apparatus and method of explosively fracturing a subterranean formation about a well bore penetrating the subterranean formation in which a central charge has the initial detonation enhanced and sustained over a protracted interval so as to not only fracture extensively immediately around the well bore but propagate a fracture deeply into the formation for enhanced production of the fluid from the formation; yet, safely create the fracture without intolerable damage to the well and ruining the well.

These and other objects will become apparent from the descriptive matter hereinafter, particularly when taken in conjunction with the appended drawings.

In accordance with this invention, there is provided an improvement in an apparatus for explosively fracturing a subterranean formation, the apparatus including:

a. elongage casing having a center and two ends;

b. opposed end explosive charges disposed at each end of the casing and adapted to direct respective explosions toward the center; and c. a center explosive charge disposed at the center and adapted to create a central zone of high pressure upon detonation;

the improvement comprising:

d. having the central charge being substantially centrally located along the axial length of the casing intermediate the end charges for creating a central area of high pressure upon detonation;

e. having each of the end charges adapted to direct an explosive force inwardly to contain the explosion of the center charge and to detonate an intermediate charge;

f. a pair of intermediate charges disposed respectively between the central charge and each of the end charges, the intermediate charges comprising elongate drivers for enhancing and sustaining exceptionally high pressure generated by them in combination with the central charge explosion and the end charge explosions for propagating a fracture more deeply into the subterranean formation; and g. respective detonating means for exploding respectively the central charge and substantially immediately thereafter the end charges such that the end charges detonate the intermediate charges and enhance the centrally located explosion to enlarge the fractured area in the subterranean formation and extend the fracture more deeply into the subterranean formation.

BRIEF DESCRIPTION OF THE DRAWINGS

FIG. 5 is an end view of the end charge, or secondary driver, internally of the apparatus of FIG. 1.

FIG. 6 is a side view of the end charge, or driver, of FIG. 5.

FIG. 7 is a side view of the intermediate, or over pressure, charge interiorly of the apparatus of FIG. 1.

DESCRIPTION OF THE PREFERRED EMBODIMENTS

Figure 1:
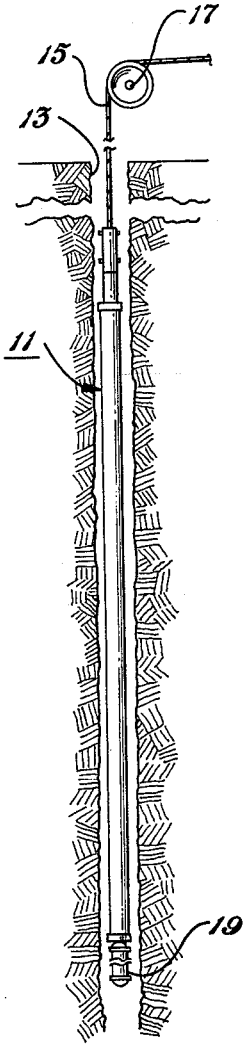
FIG. 1 is a schematic side elevational view showing an apparatus in accordance with an embodiment of this invention emplaced in a subterranean formation to be fractured adjacent a well bore penetrating the subterranean formation.

Referring to FIG. 1, there is illustrated an earth fracturing apparatus 11 in accordance with this invention lowered into a borehole 13 by way of a wire line 15 over suitable pulley or sheave 17 by conventional surface unit (not shown). If the borehole is filled with fluid, one or more sinker bars 19 may be employed to obtain the desired velocity going into the hole. The borehole 13, electric firing cable 15, sheave 17 and sinker bars 19 are all conventional and need not be described in greater detail herein. The fracturing apparatus 11 is illustrated in greater detail in FIGS. 1*a* and 1*b*.

Figure 2:
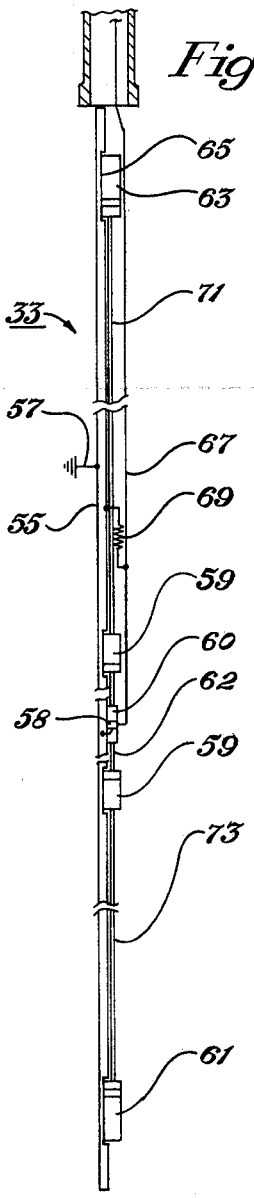
FIG. 2 is a schematic view of detonation means for detonating the explosive charges in the apparatus of FIG. 1.

Therein, the apparatus 11 includes an elongate casing, or housing, 21; opposed end charges 23, 25; a central charge 27; a pair of intermediate charges 29, 31; and respective detonating means 33, FIG. 2. The detonation means 33 are for exploding, respectively, the central charge and substantially immediately thereafter end charges such that the end charges detonate the intermediate charges and enhance the centrally located explosion to enlarge the fractured area in the subterranean formation and extend the fracture more deeply into the subterranean formation.

The casing 21 is an axially elongate tubular cylinder of carefully controlled dimensions. For example, it may comprise metallic tubular goods to be able to withstand the pressure as it is lowered into the well bore, yet prevent influx of fluids interiorly of the apparatus 11. The casing 21 is small enough to be freely lowered into the well bore, yet large enough to house the respective charges and detonating means. For example, the casing 21 may have an external diameter in the range of 2–5 inches. With most modern wells, a diameter of about $3\frac{1}{2}$ inches has been found to be satisfactory. It is desirable, however, the casing be relatively close to the diameter of the well so that the force of the explosion is not displayed along the length of the bore. Accordingly, larger diameter casings may be employed where an older well is to be fractured and the interior dimensions of the well are of larger diameter.

The casing 21 is desirably as easily destroyed as possible in order to avoid leaving debris in the well bore. Accordingly, it will have the minimum wall thickness that can withstand the pressure of the well environment. This allows its destruction with a minimum of energy during the explosion so as to maximize the amount of energy fracturing the earth. Preferred materials of construction include aluminum, magnesium, or alloys thereof. The active metals or the alloys can be employed so that the casing can participate in the chemical reaction during the explosion. A casing wall of from $\frac{1}{8}$ to $\frac{1}{4}$ inch thick has been found suitable for most downhole applications. It must be borne in mind, however, that the casing must have adequate strength to seal with respective ends and protect the interior equipment and charges.

The respective end charges 23, 25 are located respectively at the top and bottom ends of the casing 21 and are detonated from their outermost ends so that the detonation wave races inwardly toward the center. The respective end charges have respective reactive metal liners 35, 37 on their inward facing surfaces. As can be seen more clearly in FIGS. 5 and 6, the respective end charges are shaped charges of Class A explosive having a dished inwardly concave face 39 at their interior end and a convex end 41 at their exterior end. Respective end charges are also referred to as secondary drivers. The respective end charges have a cardboard housing around their outside for high temperature protection. A guide hole 43 is provided through the center of the respective charges for insertion of the detonation train of the detonating means 33 described later hereinafter. The Class A explosive is usually referred to as a composition B having a velocity of 26,000–28,000 feet per second (fps). The charge has an external dimension adapted to closely fit the internal dimension of the casing 21. Typical composition of explosive might be about 60% RDX and about 40% TNT (trinitrotoluene). Of course, any size charges can be employed. Ordinarily, the charges will have a density of about 1.7–1.8 and serve to confine the center explosion, as well as to detonate the intermediate charges 29, 31 and enhance the fracturing effect of the central charge 27.

Figure 1A:
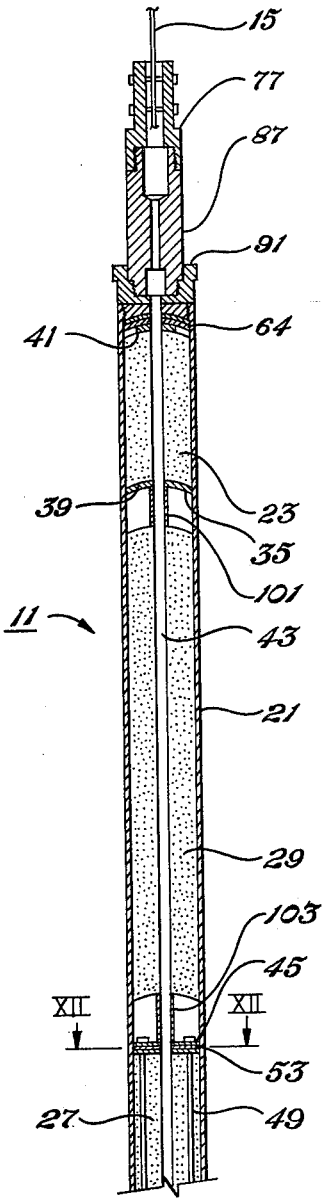
FIGS. 1*a* and 1*b* are cross sectional views of the apparatus of FIG. 1.
Figure 12:
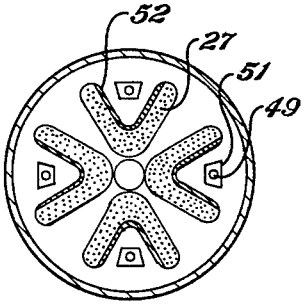
FIG. 12 is a partial cross sectional view taken along the line XII—XII of FIG. 1*a*.
Figure 4:
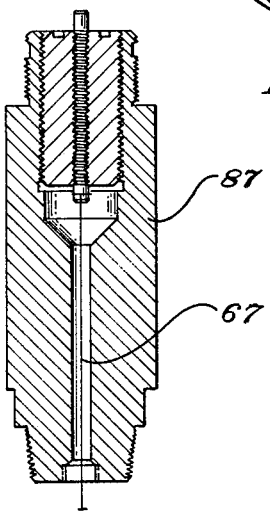
FIG. 4 is a cross sectional view of an arming nipple for use in the apparatus of FIG. 1.

The central charges 27 are actually a plurality of linear charges suspended in the casing 21 at the exact midpoint intermediate the end charges 23, 25. As illustrated, the central charges are held between aluminum plates 45, 47 by way of bolts 49 and guides 51, FIG. 12. The charges forming the central charge 27 may be of relatively conventional shaped charges such as a plurality of linear Vee-shaped charges 52 arranged parallel to the casing axis and directing the force of their explosion in a radially outward direction. Four charges are illustrated in FIGS. 1*a* and 12; but the number of charges and the size of charges can be adjusted for different purposes and different casing sizes. As illustrated, the central charges have a copper lining for cutting and severing through the casing and penetrating into the formation. The central charges 27 are linear type materials and are detonated from opposite ends to cut the casing and create the first vertical fractures through the cement and into the formation. As illustrated, the four charges are oriented at 90° to each other and spaced equally around the apparatus 11 to set-up a 360° initial fracture pattern. The primary linear shaped charges is a class A material with a velocity of detonation front of 28,000 to 30,000 feet per second.

In a typical configuration, the central charges are emplaced intermediate respective Detasheets 53 (a trademark of DuPont for sheet explosive). The upper and lower sheets of explosive are detonated at the same moment by non-electric boosters 59 as described hereinafter so the explosion peaks at the center of the axial length of the central charge 27.

A typical example may comprise 3,200 grain, ten inch long linears of the explosive, RDX, PETN (pentaerythritoltetranitrate) and plasticizer.

Thus, in sequence, the explosion of the central charge is enhanced by the detonation wave from the respective end charges which are detonated almost immediately after the central charge and effect detonation of the more slowly burning overpressure, or intermediate, charges 29, 31.

Figure 1B:
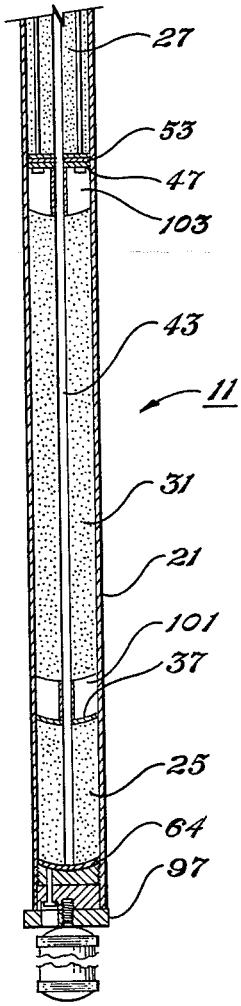

The intermediate charges 29, 31, FIGS. 1*a*, 1*b* and 7 are shaped charges consisting of class A explosive having a detonation front velocity of in the range of 16,000 to 18,000 feet per second. They are detonated simultaneously to create the third additive implosion front. Their implosive effect interacts with both the central and end charges and, since they are of a slower velocity, act as an overpressure driver to give a longer exposure of all three forces on the formation to extend the fracture more deeply into the formation. The overpressure, or intermediate, charges 29, 31 are substantially identical to the illustrated charge 29, FIG. 7, although the charge 31 is inverted if placed in the bottom position, FIG. 1*b*. The intermediate charges 29, 31 are cylindrical, having the central aperture 43 for insertion of the detonation train as described hereinbefore with respect to FIGS. 5 and 6. The intermediate charges may be encased in cardboard liner, similarly as described with respect to the respective end charges. The overpressure shaped charge may consist of a combination of materials and explosives, such as salt, aluminum, TNT (trinitrotoluene) and RDX.

The detonating means 33 is inserted into the reminder of the fracturing assembly 11 by way of the passageway, or guide hole, 43.

The detonating means 33 comprises, in addition to the conventional surface unit and electric line, a detonation series anchor rod 55, FIG. 2, with ground connections 57, electric central charge detonator 58 and respective central boosters, or detonators, 59 and end charge boosters, or detonators, 61, 63.

The detonation series anchor rod 55 is a metallic, electrically conductive rod, such as bronze, copper, aluminum or the like that have respective indentations 65 for receiving the respective detonators, or boosters.

A centrally located electrical detonator 58 is contiguous a Detasheet booster 60. The centrally located detonator 58 is connected, as by conductor 67, electrically with the electric line extending from the conventional surface equipment. A resistor 69 is connected intermediate the conductor 67 and the ground rod 55 to prevent predetonation; as from an uncontrolled source of electrical power or static electricity. As illustrated, the resistor 69 is a 1,500 ohm resistor that allows uncontrolled electrical power to drain off but still provides sufficient resistance to fire the detonators electrically from the surface. The booster 60 is contiguous an explosive booster cord 62 that traverses upwardly and downwardly to the respective non-electrical boosters, or central charge detonators, 59. As illustrated, the explosive booster cord is Primaline (trademark for explosive booster line). The centrally located electrical detonator 58 is a floating bridge wire, internally grounded electric cap. The booster 60 is Detasheet. The electric cap detonates the Detasheet (booster 60) when the circuit is closed by the operator at the surface equipment (not shown). The centrally located electric detonator 58 must be centered with precision. In fact, it has been found necessary to hold its location within plus or minus 1/16 inch, and preferably within plus or minus 1/64 inch, of the exact center to assure proper detonation sequence and timing. One of the advantages of this invention is that the electrical detonator 58 can be attached to the detonation train, or detonating means, 33 at the well site. This allows keeping the gun, or fracturing assembly, 11 effectively disarmed; since the electric detonator 58 is the only way the assembly can be fired. Specifically, the charges are otherwise resistant to physical shock and naturally occuring tendencies to detonate. The Detasheet booster, in turn, detonates the Primaline 62 from the center toward each of the non-electrical boosters 59. The Primaline has a detonation wave front velocity of 26,000 feet per second and may be, for example, eight grain Primaline to the respective end charge detonators, or boosters, 59. The non-electrical central charge boosters, or detonators, 59 are emplaced in respective indentations in the anchor rod 55. The non-electrical boosters 59 have respective interiorly facing lead azide explosives contiguous the interior Primaline 62. The lead azide explosives are also contiguous exteriorly placed respective RDX explosives. The RDX explosives are also contiguous the Detasheets 53 on the central charges 27 and the Primaline booster cords 71, 73, FIGS. 2 and 11. Thus, the RDX explosives serve two purposes—they detonate the respective ends of the central charges 27 by way of the Detasheets 53 and detonate the Primaline booster cords 71, 73 toward the respective non-electrical end charge boosters, or detonators, 61, 63. Each of the end charge boosters, or detonators, 61, 63 include three explosive elements to ensure detonation of the end charges 23, 25. The three explosive elements comprise, respectively, interiorly placed lead azide explosive, central RDX explosive and exteriorly placed Detasheet. The Detasheets of the respective boosters 61, 63 are adjacent respective Detasheets 64 emplaced contiguous respective exterior ends of the respective end charges 23, 25. In each of the end charge boosters 61 63, the Primaline detonates the lead azide which in turn detonates the RDX explosive. The RDX explosive then detonates, by way of Detasheet, the outward ends of the end charges.

Figure 11:
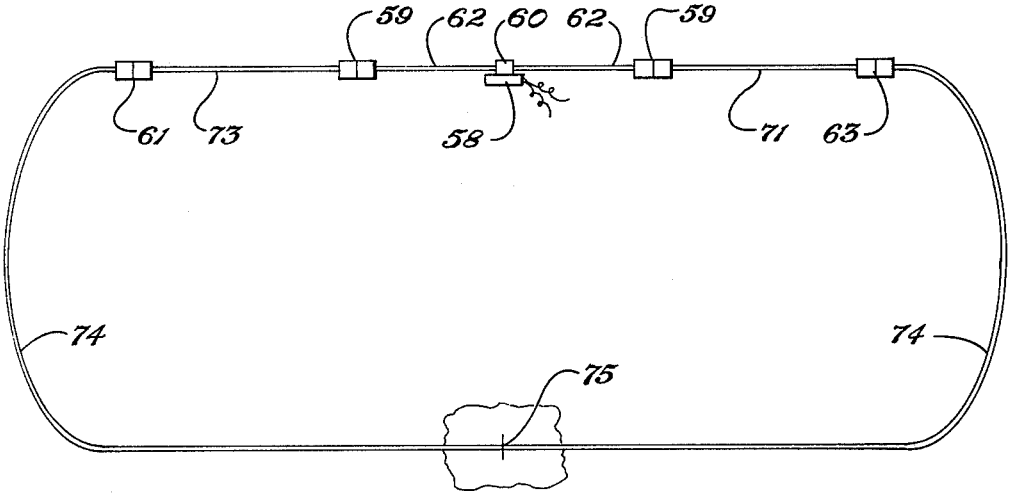
FIG. 11 is a schematic view of a test apparatus illustrating the relative positioning of the detonation means for detonating the respective charges.

It has been found that the central explosive charges must be centered within 1/16 inch and preferably within 1/64 inch tolerance with respect to the end charges in order to obtain the respective detonation fronts arriving so as to satisfactorily reinforce the central charge detonation and propagate the fracture sufficiently deeply into the formation. As can be seen in FIG. 11, this invention has been tested by sequentially detonating the respective central electrical cap 58, booster 60, Primaline 62, non-electrical boosters 59, Primaline 71, 73; and subsequently detonating the end charge boosters 61, 63. The boosters 61, 63 detonate the test loop Primaline 74. As the test circuit has the detonation front arrive at the midpoint 75, the waves arrive within 1/64 inch of each other to crease a marker or the like.

Figure 3:
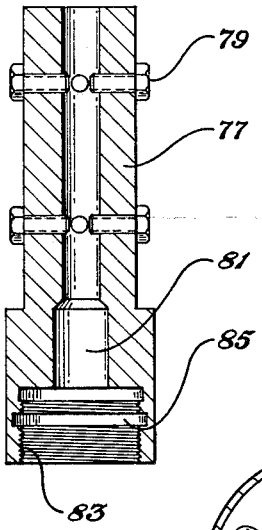
FIG. 3 is a cross sectional view of the wire rope socket for use in the apparatus of FIG. 1.

The entire tool is assemblied and the wire rope socket 77, FIG. 3, grounded and emplaced. It is connected to the wire line by way of bolts 79. The bolts may be for example, ¼ inch by ¾ inch bolts (8 required). A chamber 81 is provided for the electrical hookup. The field arming wire hook up is given a positive connection with the wireline conductor. An insulator is provided. The chamber is filled with silicone in the field. A threaded sector 83 is provided for interconnection. Suitable O-ring grooves 85 may be employed as desired. The wire rope socket should have a line pull disconnect of 1,750 pounds and a grounding mechanism to ground to the wire line truck or the like. The arming nipple 87 is connected in place with the electrical conductor 67 running therethrough.

Figure 9:
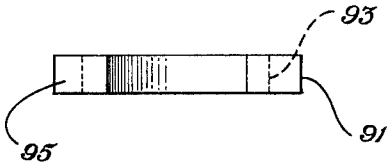
FIG. 9 is a side elevational view of the top buffer pad and insulator of FIG. 8.
Figure 8:
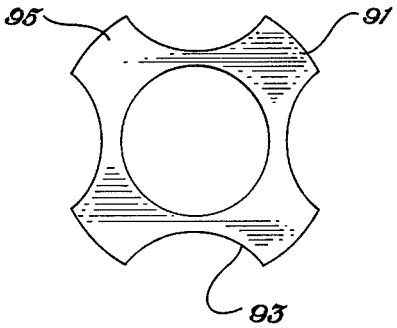
FIG. 8 is a top view of the top buffer and friction pad and static electricity insulator.

The apparatus 11 includes a top buffer and friction pad and static electricity insulator 91, FIGS. 1*a*, 8 and 9. The top pad 91 has fluid passage grooves 93 that serve as ports to allow the downhole fluid to bypass the apparatus 11. The pad includes centralizers 95 to provide stand-off from the well casing. The centralizer distance is critical for the 360° even application of the forces. The top buffer pad 91 is formed of Nylon or other electrically non-conductive material.

Figure 10:
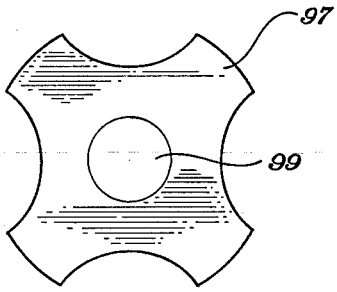
FIG. 10 is a top plan view of the bottom buffer and friction pad and static electricity insulator for use in the apparatus of FIG. 1.

The apparatus 11 also includes a bottom buffer and friction pad and static electricity insulator 97, FIGS. 1*b* and 10. The bottom pad 97 includes an air valve access aperture 99 which also serves to receive sinker bars and the like.

The apparatus 11 includes spacers 101, 103, between respectively, the end charges, intermediate charges and the central charge. These spacers are useful in placing the charges and maintaining them at exactly the correct distance. It is in this area, however, that it is probable that further improvements need to be made to improve the fracturing apparatus 11. As noted in U.S. Pat. No. 4,160,412, it is theorized that the voids between the respective charges are benefical. It is probable, however, that they can be improved.

In operation, the earth fracturing apparatus 11 is lowered into the well by conventional means such as a cable attached to the top of the fracturing apparatus 11, as by way of the wire rope socket 77 and the arming nipple 87. Of course, the electrical detonating conductors and the detonating means 33 will have been connected together and inserted through the guide hole 43 to have carefully emplaced the detonators at their exact and critical location. One of the advantages of this invention is that it can be carried to a using site without the detonation train in place and can be assemblied in the field for greater safety. This prevents spurious detonation, as by radio signals or the like.

When the apparatus is stationed at the proper depth in the well, the central charges are detonated by throwing the switch at the surface equipment (not shown). This initiates detonation of the electric cap 58, booster 60, Primaline 62, non-electrical boosters 59, Detasheet 53 and the central charges 27. The central charges focus the force of their explosion in a radially outwardly direction to cut through the well casing lining the bore hole, through the cement and initiate penetration into the subterranean formation. The illustrated linear charges focus the explosive force along a line to initiate vertical fractures. Of course, if other shaped charges are employed, other forms of initiation of the fracture can result.

As indicated hereinbefore, the Primaline detonates by way of the boosters 61, 63 as described hereinbefore, the outermost ends of the respective end charges 23, 25. The end charges generate high temperature and pressure to vaporize the reactive metal coating, reinforce the central explosion and effect detonation of the intermediate charges. Specifically, the merging of the detonation waves and explosive force from the respective end charges, traveling in excess of 22,000 feet per second, can enlarge the fractures in the earth initiated by the central charges 27.

In addition to the reinforcement caused by the explosive force of the inwardly directed end charges, a far greater reinforcement is achieved through the kinetics of both exothermac reaction and the detonation of the intermediate charges 29, 31.

With the apparatus of this invention, pressures on the order of 43.6 millions pounds per square inch have been generated. This is contrast to the prior art peak pressures of about 21 millions pounds per square inch. The resultant peak pressure, more than double that of the prior art, propagates the fractures more deeply into the subterranean formation for improved results. Yet, because of the construction of the fracturing apparatus, there is less downhole damage to the well than was achieved by the prior art.

The following examples illustrate specific fracturing apparatus 11 that has been found satisfactory in fracturing a variety of subterranean formations.

EXAMPLE I

In this example, the end charges comprise cone dished head shaped charges having composition B with 26,000 feet per second velocity with the weight of about two and one half pounds in cardboard housing, about six inches long and about three and three sixteenth inches in diameter. A nine sixteenth inch guide hole 43 was employed. The intermediate charge had from 16,000 to 18,000 feet per second velocity, weighed about 7–8 pounds with a cardboard housing surrounding it with the usual guide hole. The length was about seventeen and one-half inches and the same diameter as the end charges. The central charge 27 comprised four linear charges ten inches long formed of 3,200 grains of RDX, PETN and plastizer blend held in place as illustrated. These explosives were assembled in a casing with about $3\frac{1}{2}$ inches space therebetween. The ignition train was formed to form the detonation means as described hereinbefore.

This fracturing apparatus 11 was then used to fracture subterranean formations running from the Buda, the Austin Chalk, Conglomerate, Windsor Canyon Sand, and Woodbine. The fracturing was on both oil wells and gas wells. The improvement in the oil wells ranged from 15 to 36 barrels of oil per day (with only nominal downhole damage that was readily cleaned up) to an improvement of from 9 barrels a day to 56 barrels of oil per day in the Austin Chalk. Again only a nominal bridging was effected after the fracturing with the explosive fracturing apparatus 11. There has been no evidence of coning into the production zone of water or the like following the fracturing.

From the foregoing, it can be seen that this invention achieves the objects delineated hereinbefore. More particularly, it allows forming and propagating into a subterranean formation a fracture by means of explosive fracturing without the massive damage that has been done by the prior art attempts at explosive fracturing. Moreover, the fractures are propagated deeply into the formation to enable satisfactory production of fluids from the subterranean formation-in contrast to the prior art where the subterranean formations attenuated the high frequency explosive wave without satisfactory depth of penetration laterally into the formation.

Although the invention has been described with a certain degree of particularity, it is understood that the present disclosure is made only by way of example and that numerous changes in the details of construction and the combination and arrangement of parts may be resorted to without departing from the spirit and the scope of this invention, reference for the latter being had to the appended claims.

We claim:

1. In apparatus for fracturing a subterranean formation, including:

a. elongate casing having a center and two ends;

b. opposed end charges disposed at each end of said casing and adapted to direct respective explosions toward said center; and c. A central charge disposed at said center and adapted to create a central zone of high pressure upon detonation; the improvement comprising:

d. having said central charge being substantially centrally located along the axial length of said casing and said end charges for creating a central area of high pressure upon detonation;

e. having each of said end charges adapted to direct an explosive force inwardly to contain the explosion of said center charge and to detonate an intermediate charge;

f. a pair of intermediate charges disposed respectively between said central charge and each of said end charges, said intermediate charges comprising elongate driver for enhancing and sustaining the exceptionally high pressure generated by the combination of said central charge explosion and said end charge explosions for propagating a fracture more deeply into said subterranean formation; and g. respective detonating means for exploding respectively said central charge and substantially immediately thereafter said end charges such that said end charges detonate said intermediate charges and enhance the centrally located explosion to enlarge the fractured area in said subterranean formation and extend said fracture more deeply into said subterranean formation.

2. The apparatus of claim 1 wherein said assembled apparatus, including charges, has a central bore of the first diameter for receiving, at a well site, a detonation train; and said detonating means includes a detonation train of a second diameter adapted to be inserted within and conformingly received by said central bore; said detonation train having an anchor rod and respective detonator disposed therealong at such distances as to be emplaced adjacent the exterior ends, as measured from the center of said central charge, of, respectively, said central charge and said end charges.

3. The apparatus of claim 2 wherein said central charge comprises a plurality of longitudinally disposed linear charges; respective explosive sheets are emplaced adjacent each end of said linear charges and said exterior end of said end charges; and said detonators are disposed along said anchor rod and adapted to detonate said explosive sheets to ensure detonation of said central and end charges at their respective times.

4. The apparatus of claim 3 wherein an explosive booster cord traverses longitudinally of said anchor rod; and said detonators comprise non-electrical booster that are safe for transport and are connected contiguous said explosive booster cord; a centrally disposed, electrically fired detonator is connected contiguous said explosive booster cord at its center; said central, electrically fired detonator being armed and inserted at said well site and not before for safety.

5. The apparatus of claim 4 wherein said central electrically fired detonator comprises an electric cap and a booster contiguous said explosive booster cord to ensure detonation of said explosive booster cord.

6. The apparatus of claim 5 wherein said non-electrical boosters include central charge boosters and end charge boosters and respectively include at least lead azide explosive at the respective interior ends contiguous said explosive booster cord and RDX explosive contiguous said lead azide explosive such that said lead azide boost said explosive booster cord and ensures detonation of said RDX, which, in turn, positively detonates sheet explosive.

7. The apparatus of claim 6 wherein said RDX in said central charge boosters detonates said sheet explosive at the ends of said central charges and also detonates said explosive booster cord extending exteriorly to respective said end charge boosters.

8. The apparatus of claim 7 wherein said end charge boosters also include at their respective exterior ends sheet explosives that boosts said RDX and ensures detonation of said sheet explosive adjacent the exterior ends of said end charges.

* * * * *